United States Patent [19]

Lillie et al.

[11] Patent Number: 4,566,229

[45] Date of Patent: Jan. 28, 1986

[54] HONING TOOL

[76] Inventors: James D. Lillie, 4657 Straw La., Roscoe, Ill. 61073; Rodney D. Skibbe, 20381 Manton Rd., Sterling, Ill. 61081

[21] Appl. No.: 629,991

[22] Filed: Jul. 12, 1984

[51] Int. Cl.[4] ..... B24B 15/03

[52] U.S. Cl. ..... 51/241 VS; 51/241 S

[58] Field of Search ..... 51/241 R, 241 VS, 241 S

[56] References Cited

U.S. PATENT DOCUMENTS

| | | | |
|---|---|---|---|
| 1,560,507 | 11/1925 | Froussard . | |
| 1,673,924 | 6/1928 | Snyder . | |
| 2,758,429 | 8/1956 | Harmon | 51/184.2 |
| 3,119,209 | 1/1964 | Moore et al. | 51/241 S |
| 3,141,365 | 7/1964 | Peters | 82/4 |
| 3,142,139 | 7/1964 | Mangum | 51/241 S |
| 4,086,732 | 5/1978 | Ramsey | 51/241 |
| 4,098,029 | 7/1978 | Shiets | 51/241 S |
| 4,246,720 | 1/1981 | Stone | 46/74 |
| 4,361,061 | 11/1982 | Pullen | 82/4 |

*Primary Examiner*—Roscoe V. Parker

*Attorney, Agent, or Firm*—Leydig, Voit & Mayer, Ltd.

[57] ABSTRACT

A tool for honing an axially facing annular surface surrounding an elongated shaft includes an annulus which is placed around the shaft and supports honing stones which are engageable with the sealing surface. Rods rigid with the annulus extend longitudinally from the back of the surface and the outer ends of the rods extend beyond the end of the shaft and are rigidly connected to a plate. The latter is adapted to be turned by power about the longitudinal axis of the tool so that the annulus is rotated about this axis and the honing stones polish the sealing surface. Radially adjustable fingers project out beyond the periphery of the annulus and engage a cylindrical wall surrounding the sealing surface to maintain the annulus centered with the sealing surface.

6 Claims, 7 Drawing Figures

HONING TOOL

BACKGROUND OF THE INVENTION

It is common practice to use a honing operation to smooth and polish surfaces which have been rough machined or have become corroded. One type of surface for which such an operation is used is an axially facing annular surface which forms part of a seal such as the seal around the shaft of the actuator for a valve. In such a case, the shaft interferes with the honing of the surface in place and it has been necessary to remove the part on which the surface is formed, transport the part to a place where the honing is performed, return the part and then reassemble it with the valve. This has been cumbersome, time-consuming and expensive.

SUMMARY OF THE INVENTION

The general object of the invention is to provide a new and improved honing tool which may be used to clean and polish an axially facing annular surface even though there is a member such as a shaft projecting axially outwardly from the surface.

A more detailed object is to achieve the foregoing by forming the tool with an annulus which encircles the shaft and opposes the work surface to be honed and which carries a plurality of honing stones engageable with the work surface and to rotate the annulus about its center by power applied axially but beyond the end of the shaft.

It also is an object to provide a novel means for centering the annulus relative to the work surface.

DETAILED DESCRIPTION OF THE PREFERRED EMBODIMENT

Figure 1:
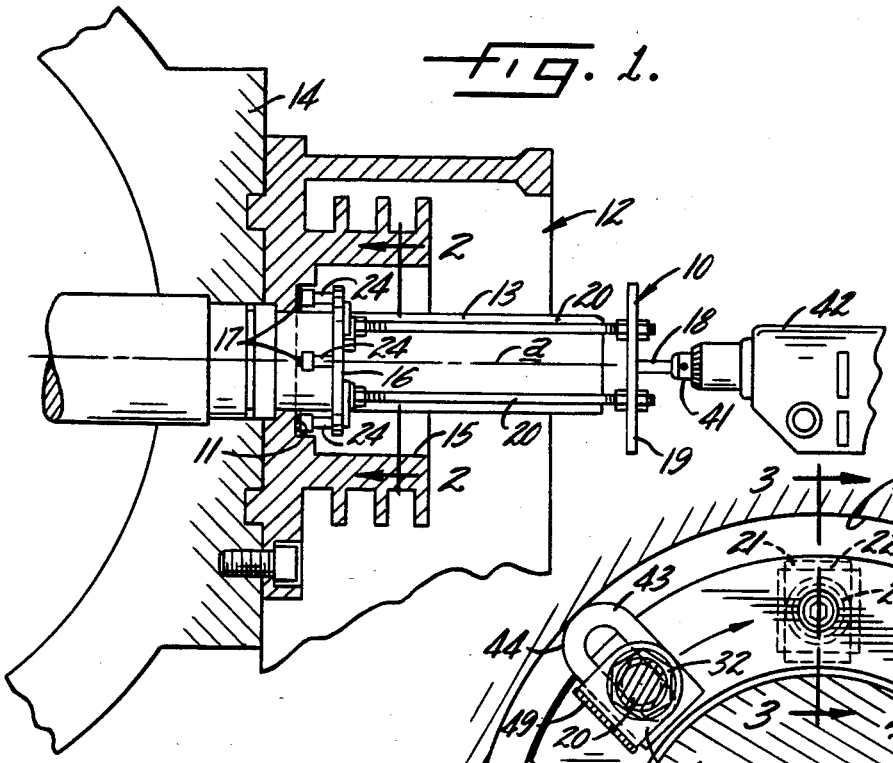
FIG. 1 is a fragmentary sectional view of a valve with a honing tool embodying the present invention in place to hone an annular surface associated with the valve.

As shown in the drawings for purposes of illustration, the invention is embodied in a tool 10 for smoothing and polishing an axially facing annular work surface, herein a sealing surface 11, which either has been rough machined or has become corroded in service use. In the example shown, the sealing surface is associated with a packing gland used in connection with a bearing assembly 12 for the shaft 13 of a comparatively large butterfly valve (not shown) disposed within a housing 14. The shaft is coaxial with the sealing surface and projects through the housing while the sealing surface is recessed and surrounded by a cylindrical wall 15. Heretofore, it has been impractical to grind and polish the sealing surface in place primarily because of the presence of the valve shaft and, accordingly, it has been customary to disassemble the housing of the bearing assembly 12 from the valve housing and transport it to a remote place where it is machined. This procedure is both costly and time-consuming.

The present invention contemplates the provision of a novel honing tool 10 which is readily accessible to the work surface 11 in spite of the presence of the shaft 13, which is easy to use and which is comparatively inexpensive. To these ends, the tool includes an annulus 16 which encircles the shaft 13 and opposes the work or sealing surface 11 and to rotate this annulus about its center by power applied coaxially with the annulus but beyond the end of the shaft so that the work surface is honed by a plurality of stones 17 carried by the annulus. The drive is effected through a shaft 18 which is coaxial with the annulus and which is rigid with a plate 19 disposed beyond the end of the shaft 13 parallel to the annulus and the plate and the annulus are rigidly connected to turn together by a plurality of elongated rods 20 angularly spaced around the axis a of the drive shaft 18.

Figure 2:
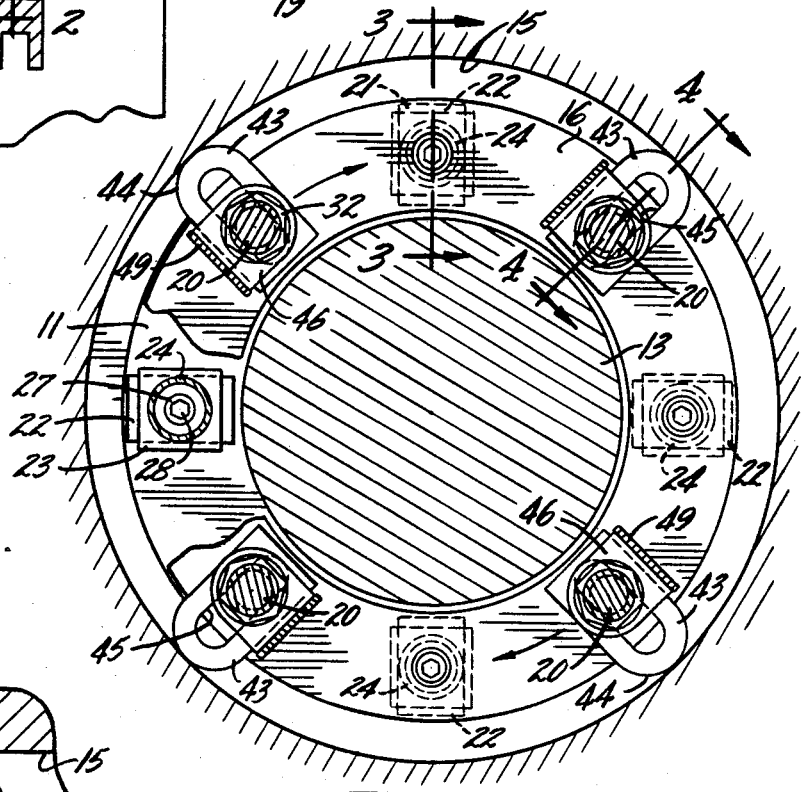
FIG. 2 is an enlarged sectional view taken along the line 2—2 in FIG. 1.
Figure 3:
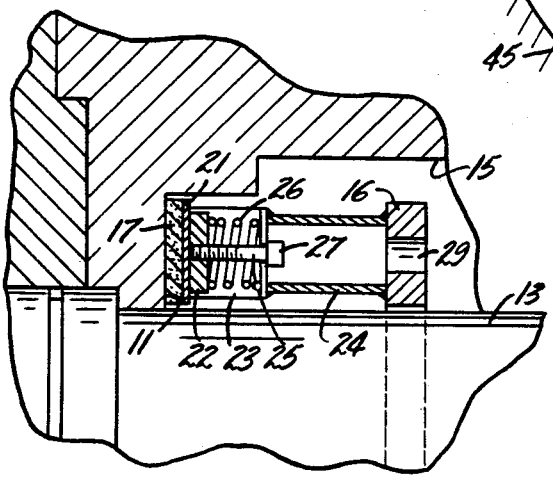
FIG. 3 is a fragmentary sectional view taken along the line 3—3 in FIG. 2.
Figure 5:
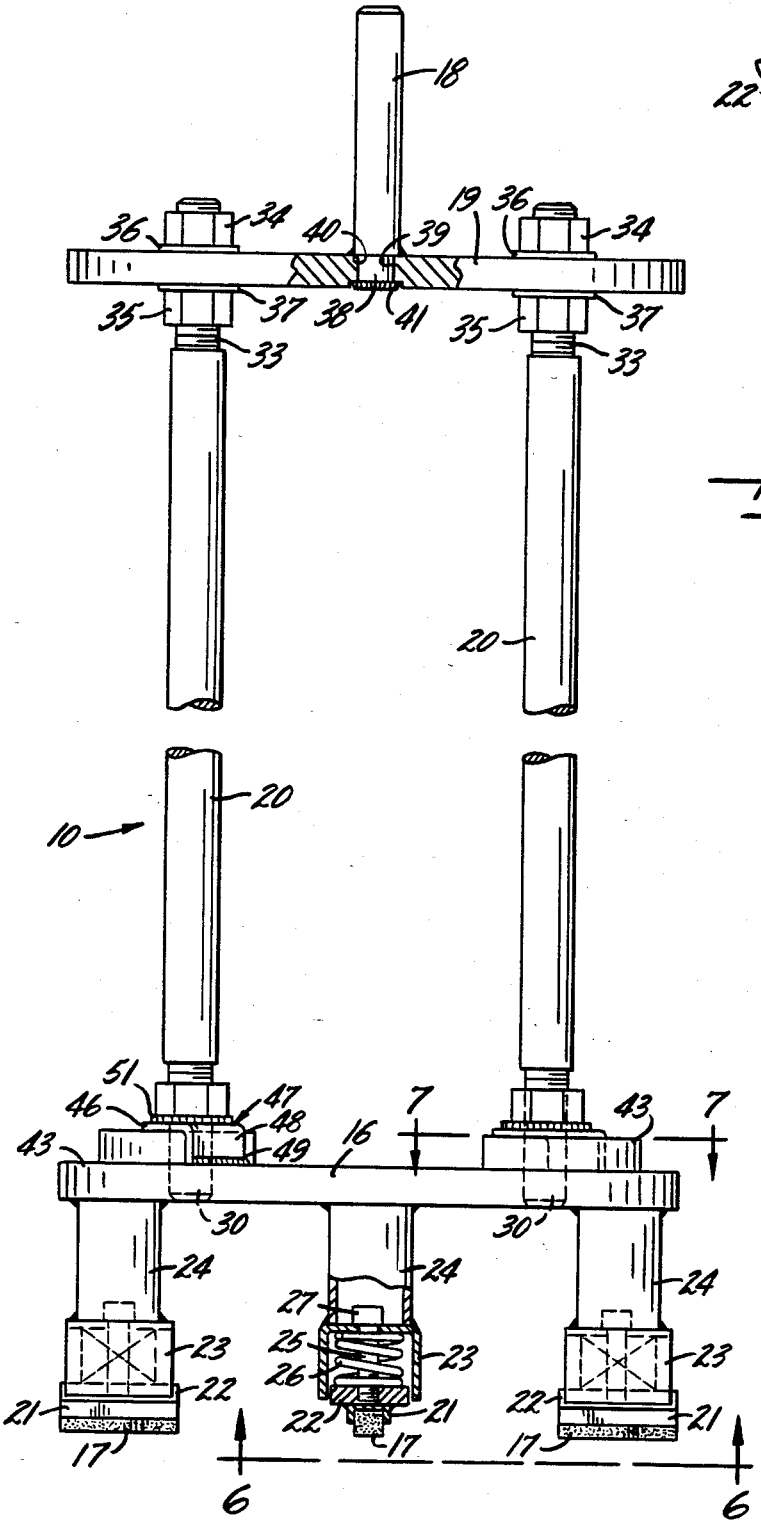
FIG. 5 is a side elevation of the tool, parts being broken away and shown in section.

In the form shown in the drawings, there are four honing stones 17, although one of the stones may be replaced by a conventional wiper if desired, and each stone is the customary rectangular stick of abrasive particles bonded in a rigid matrix and is held in an elongated holder 21 of U-shaped cross-section (see FIG. 5). The back of the holder is welded to a rectangular bar 22 which slides in an inverted U-shaped guide 23 welded to one end of a tubular extension 24, the other end of the extension being welded to the annulus 16. The stone is resiliently urged outwardly of the guide and against the work surface 11 and, for this purpose, a bolt 25 projects loosely through the crosspiece of the guide and is threaded into the bar 22 and a helical compression spring 26 encircles the bolt and acts between the crosspiece and the bar. In order to replace worn stones, the head 27 of the bolt is formed with a recess 28 (FIG. 2) for an allen wrench and the recess is accessible to the wrench through a hole 29 (FIG. 3) in the annulus so that the stone 17, the holder 21 and the bar 22 may be removed and replaced with a new stone assembly. The arrangement also permits each stone to float independently of the others to maintain proper contact with the work surface. As illustrated most clearly in FIG. 2, the extensions 24 and hence the stones 17 are equally spaced around the annulus.

Figure 4:
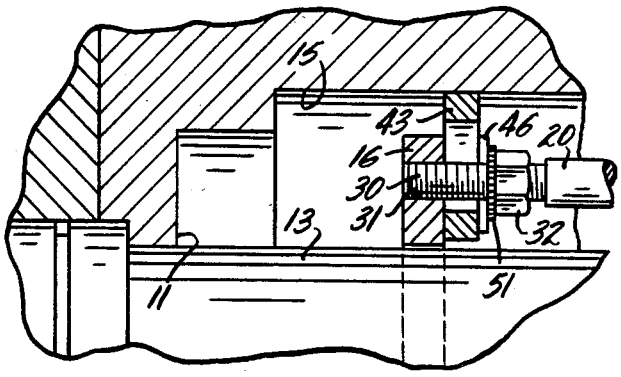
FIG. 4 is a fragmentary sectional view taken along the line 4—4 in FIG. 2.

The end plate 19 is circular and is substantially the same diameter as the annulus 16, both being centered on the axis a extending longitudinally of the tool, and the plate lies in a plane parallel to the annulus but is spaced axially from the latter so that the plate is disposed beyond the end of the valve shaft 13 when the honing stones engage the work surface 11. The rods 20, herein four in number, parallel the axis a and are spaced radially outwardly from the latter to clear the valve shaft when the annulus opposes the work surface. As shown in FIG. 4, the forward end portion of each rod is reduced and threaded as indicated at 30 and this end portion is received in a threaded hole 31 in the annulus. As will be described more in detail later, the rod is held in its assembled position on the annulus by a nut 32 received on the threaded end portion 30. The outer end portion 33 (FIG. 5) of the rod also is threaded and projects loosely through the plate 19 and nuts 34 and 35 threaded onto this end portion on opposite sides of the plate are tightened against lock washers 36 and 37 to hold the plate in a fixed position on the rod. The rods are equally spaced angularly around the plate and the annulus with each disposed midway between two adjacent honing stone assemblies.

As thus assembled, the rods 20 rigidly connect the annulus 16 and the plate 19 against endwise movement relative to each other and for rotation together. To rotate this assembly, the drive shaft 18 is rigidly mounted on the plate and projects outwardly from the latter along the axis a. Herein, the inner end portion 38 (FIG. 5) of the shaft is reduced in diameter and projected into a center hole 39 in the plate with the shoulder 40 thus formed abutting the outer side of the plate. The shaft is welded to the outer side of the plate around the shoulder 40 and the inner end of the shaft is upset as indicated at 41' to complete the rigid connection of the shaft to the plate. Preferably, the shaft diameter is selected to be received in the chuck 41 of a standard portable drill motor 42 (FIG. 1) which thus may be used as the power source for the tool.

Figure 6:
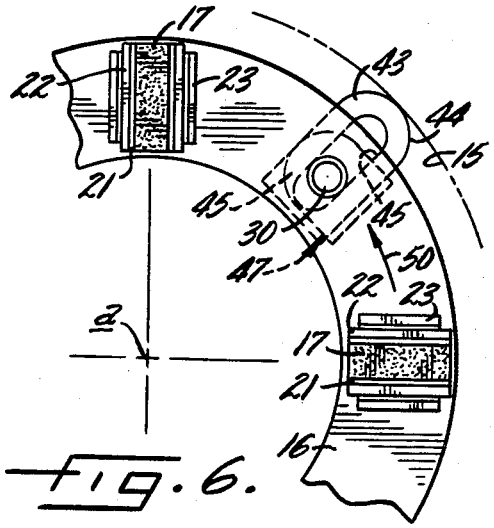
FIG. 6 is a fragmentary end view of the tool as seen at the line 6—6 in FIG. 5.
Figure 7:
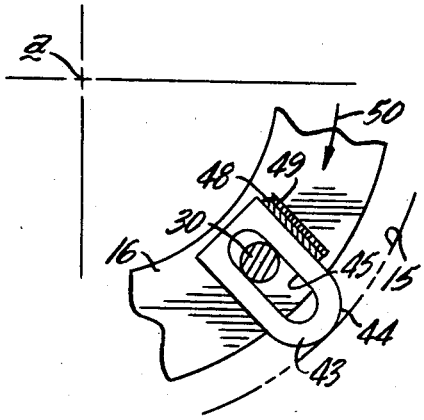
FIG. 7 is a fragmentary sectional view taken along the line 7—7 in FIG. 5.

In accordance with a more detailed aspect of the invention, advantage is taken of the presence of the cylindrical wall 15 surrounding the work surface 11 to center the tool 10 relative to the work surface. For this purpose, the tool incorporates a plurality of fingers 43 which project radially from the annulus and are adjustable in their radial position so that they lightly engage the wall 15 when the axis a of the tool is alined with the center of the work surface whereby the fingers cooperate with the wall to maintain this centered relationship. Herein, each finger is flat and is slidable on the outer surface of the annulus with a rounded surface 44 formed on the outer end of the finger to engage the wall 15. A longitudinal slot 45 receives the threaded forward end portion 30 of a rod 20 while permitting the finger to slide radially and there is a finger associated with each rod. To maintain the radial orientation of the finger regardless of its adjusted position, the horizontal leg 46 of an inverted L-shaped clip 47 overlies the finger (see FIG. 5) and the vertical leg 48 is disposed along one side of the finger and is welded to the outer side of the annulus as indicated at 49. As illustrated in FIGS. 6 and 7, the vertical leg is at the trailing side of the finger, the arrow 50 indicating the direction of rotation of the annulus. The threaded end portion 30 of the associated rod also projects through a hole in the horizonal leg of the clip (see FIG. 4) and, through a lock washer 51, the nut 32 is threaded down against the leg. The clip yields slightly so that the nut thereby clamps the finger in its adjusted position between the annulus and the horizontal leg of the clip.

It will be observed that, with a tool 10 as described above, the annular sealing surface 11 can be honed while it remains in its service position relative to the valve housing 14 and shaft 13. Thus, the annulus 16 is merely inserted over the shaft which thus projects into the space inside the rods 20 and the stones 17 are brought into engagement with the sealing surface. The chuck 41 of the drill motor 42 is clamped about the drive shaft 18 and, when the motor is energized, the plate 19, the rods 20 and the annulus 16 turn together about the axis a. As a result, the honing stones revolve about this axis and clean or polish the sealing surface. During this operation, the fingers 43 engage the cylindrical wall 15 and keep the annulus centered on the axis a. To accommodate the specific diameter of the cylindrical wall, the nuts 32 may be loosened, the fingers moved radially in or out as required and the nuts tightened to clamp the fingers in their adjusted positions.

We claim:

1. A tool for honing an annular work surface surrounding an axially projecting member, said tool having, in combination, a flat annulus adapted to encircle said member and having a forward side opposing said surface, a plurality of honing stone holders mounted on the forward side of said annulus and angularly spaced around the latter, a plurality of honing stones, one for each of said holders and each mounted in the associated holder and facing axially away from said annulus, a plate parallel to said annulus and spaced behind the other side of the latter, a plurality of elongated rods extending between and fixed to said plate and said annulus and rigidly connecting the plate to the annulus, said rods being angularly spaced around the longitudinal axis of said annulus thereby to permit said axially projecting member to project through said annulus and toward said plate when said honing stones engage said work surface, and a drive shaft rigid with and extending rearwardly from said plate, said shaft being axially alined with the axis of said annulus and adapted to be connected to a power actuator to turn said plate and said annulus bodily therewith and revolve said stones about said axis and around said work surface.

2. A tool for honing an annular work surface surrounding an axially projecting member, said tool having, in combination, a flat annulus adapted to encircle said member and having a forward side opposing said surface, a plurality of honing stone guides rigidly mounted on the forward side of said annulus and angularly spaced around the latter, said guides opening forwardly toward said work surface, a plurality of honing stone holders, one slidable in each of said guides, a plurality of honing stones, one for each of said holders and each mounted in the associated holder and facing axially away from said annulus, spring means resiliently urging said holders forwardly in said guides whereby said stones resiliently engage said work surface, a plate parallel to said annulus and spaced behind the other side of the latter, a plurality of elongated rods extending between and fixed to said plate and said annulus and rigidly connecting the plate to the annulus, said rods being angularly spaced around the longitudinal axis of said annulus thereby to permit said axially projecting member to project through said annulus and toward said plate when said honing stones engage said work surface, and a drive shaft rigid with and extending rearwardly from said plate, said shaft being axially alined with the axis of said annulus and adapted to be connected to a power actuator to turn said plate and said annulus bodily therewith and revolve said stones about said axis and around said work surface.

3. A tool for honing an annular work surface surrounding an axially projecting member, said work surface being associated with a coaxial cylindrical wall, said tool having, in combination, a flat annulus adapted to encircle said member and having a forward side opposing said surface, a plurality of honing stone holders mounted on the forward side of said annulus and angularly spaced around the latter, a plurality of honing stones, one for each of said holders and each mounted in the associated holder and facing axially away from said annulus, a plate parallel to said annulus and spaced behind the other side of the latter, a pluralithy of elongated rods extending between and fixed to said plate and said annulus and rigidly connecting the plate to the annulus, said rods being angularly spaced around the longitudinal axis of said annulus thereby to permit said axially projecting member to project through said annulus and toward said plate when said honing stones engage said work surface, a drive shaft rigid with and extending rearwardly from said plate, said shaft being axially alined with the axis of said annulus and adapted to be connected to a power actuator to turn said plate and said annulus bodily therewith and revolve said stones about said axis and around said work surface, and a plurality of fingers angularly spaced around said annulus and projecting radially of the latter to engage the cylindrical wall and center the tool relative to the work surface.

4. A tool as defined in claim 3 wherein the cylindrical wall surrounds said work surface and in which said fingers project radially outwardly beyond the outer periphery of said annulus.

5. A tool as defined in claim 4 in which each of said fingers is formed with a longitudinal slot receiving one of said rods whereby the radial position of the finger may be adjusted by sliding the finger radially on said annulus, said tool including means to clamp said fingers in their adjusted positions against said annulus.

6. A tool as defined in claim 5 including a plurality of clips, one for each of said fingers and each rigidly mounted on said annulus and engaging the associated finger to permit the latter to slide radially without turning.

* * * * *